US012305350B2

(12) United States Patent
Daysh et al.

(10) Patent No.: US 12,305,350 B2
(45) Date of Patent: May 20, 2025

(54) PILE INSTALLATION SYSTEM

(71) Applicant: Daysh Developments, Inc., Benicia, CA (US)

(72) Inventors: Paul Daysh, Concord, CA (US); Howard Perko, Fort Collins, CO (US); Troy Lyver, Portland, OR (US)

( * ) Notice: Subject to any disclaimer, the term of this patent is extended or adjusted under 35 U.S.C. 154(b) by 115 days.

(21) Appl. No.: 17/889,259

(22) Filed: Aug. 16, 2022

(65) Prior Publication Data

US 2023/0047667 A1 Feb. 16, 2023

Related U.S. Application Data

(60) Provisional application No. 63/233,672, filed on Aug. 16, 2021.

(51) Int. Cl.
*E02D 7/22* (2006.01)
*E02D 5/56* (2006.01)

(52) U.S. Cl.
CPC ..... *E02D 5/56* (2013.01); *E02D 7/22* (2013.01)

(58) Field of Classification Search
CPC .. E02D 5/56; E02D 5/223; E02D 7/22; E02D 5/801
See application file for complete search history.

(56) References Cited

U.S. PATENT DOCUMENTS 6,142,712 A 11/2000 White et al.
6,412,235 B1 * 7/2002 Pylant ..... E02D 5/801 175/323
2004/0163336 A1 * 8/2004 Hsu ..... E04H 12/2223 52/157
2011/0217125 A1 * 9/2011 Kasprick ..... E02D 13/04 405/252.1
2016/0281432 A1 * 9/2016 Queen ..... E02D 5/56

FOREIGN PATENT DOCUMENTS

KR 2018112642 A * 10/2018 ..... E02D 5/523
KR 2020102637 A * 9/2020

* cited by examiner

*Primary Examiner* — Benjamin F Fiorello
*Assistant Examiner* — Stacy N Lawson
(74) *Attorney, Agent, or Firm* — Brian Beverly; Beeson Skinner Beverly, LLP

(57) ABSTRACT

A foundation pile installation system includes a hollow foundation pile having a pair of cooperating tapered drive pin slots at its top end and a pair of drive pin holes spaced below and aligned with the drive pin slots, first and second drive pins, a drive head having a drive collar and a flared lid, the drive collar having top and bottom drive pin holes, the drive collar for insertion in the top end of the pile in an assembled configuration in which the first drive pin inserted in the top drive pin holes of the drive collar is received in the drive pin slots of the pile and the second drive inserted in the bottom drive pin holes of the drive collar is received in the drive pin holes of the pile to secure the drive head to the pile, the tapered drive pin slots guiding the first drive pin into the slots as the drive head is inserted in the pile.

10 Claims, 9 Drawing Sheets

PILE INSTALLATION SYSTEM

CROSS-REFERENCE TO RELATED APPLICATION

This application claims the benefit of U.S. Provisional Application No. 63/233,672 filed Aug. 16, 2021, which is incorporated herein fully by reference.

BACKGROUND

Technical Field

The present invention relates generally to driving foundation piles into the ground and more particularly relates to a system for installing hollow foundation piles using a pile having one or more pairs of drive slots.

Description of Related Art

The traditional method for driving a hollow foundation pile in the ground uses a pile having two pairs of axially spaced drive pin holes for attachment of a drive head, in hard soils, the drive head can be attached to the pile with two pins, otherwise one drive pin is usually sufficient. When the pile has been driven the pin or pins are removed and the drive head detached. While effective, it is time consuming and cumbersome to attach and remove the pile from the drive head and limits the depth to which the pile can be driven into the ground since the drive pins must at some point be removed.

There is therefore a need for a pile installation system that facilitates attachment and detachment of the pile from the drive head and allows the pile to be driven to a desired depth without concern for removing drive or attachment pins from the pile.

SUMMARY OF THE INVENTION

A pile installation system according to the invention includes a pile having one or more pairs of cooperating drive bar slots opening upwardly on the top end of the pile and one or more pairs of attachment pin holes axially spaced below the lower ends of the pile drive bar slots. A drive head includes a drive collar having a hollow interior, a lid covering the top of the drive collar, and one or more drive bars affixed to the underside of the lid. The pile is engaged with the drive head by inserting the pile in the drive collar, rotating the pile until the drive bar slots radially align with the drive bars, and further inserting the pile in the drive collar until the drive bars engage the drive bar slots and the top of the pile abuts the lid. The pile may further be attached to the drive head by inserting an attachment pin in cooperating attachment pin holes in the drive collar and pile.

A second embodiment of a pile installation system includes a pile having a tubular body, a pair of drive pin slots and a pair of attachment pin holes axially spaced below the drive pin slots on opposite sides of the top end of the pile. A drive head includes a drive shaft and a circular flange extending radially from the drive shaft. The drive shaft includes a pair of drive pin holes and a pair of attachment pin holes axially spaced below the drive pin holes. The pile is attached to the drive head by preinstalling a drive pin in the drive pin holes in the drive shaft, inserting the drive shaft into the pile, aligning the drive pin with the drive pin slots in the pile and fully inserting the drive shaft in the pile until the drive pin engages the lower ends of the drive pin slots.

An attachment pin may then be inserted into cooperating attachment pin holes in the pile the cooperate with the attachment pin holes in the drive shaft to secure the pile to the drive head.

In both embodiments, once the pile is attached to the drive mechanism, the pile can be picked up and positioned where desired for driving into the ground.

DETAILED DESCRIPTION OF THE ILLUSTRATED EMBODIMENT

Figure 1A:
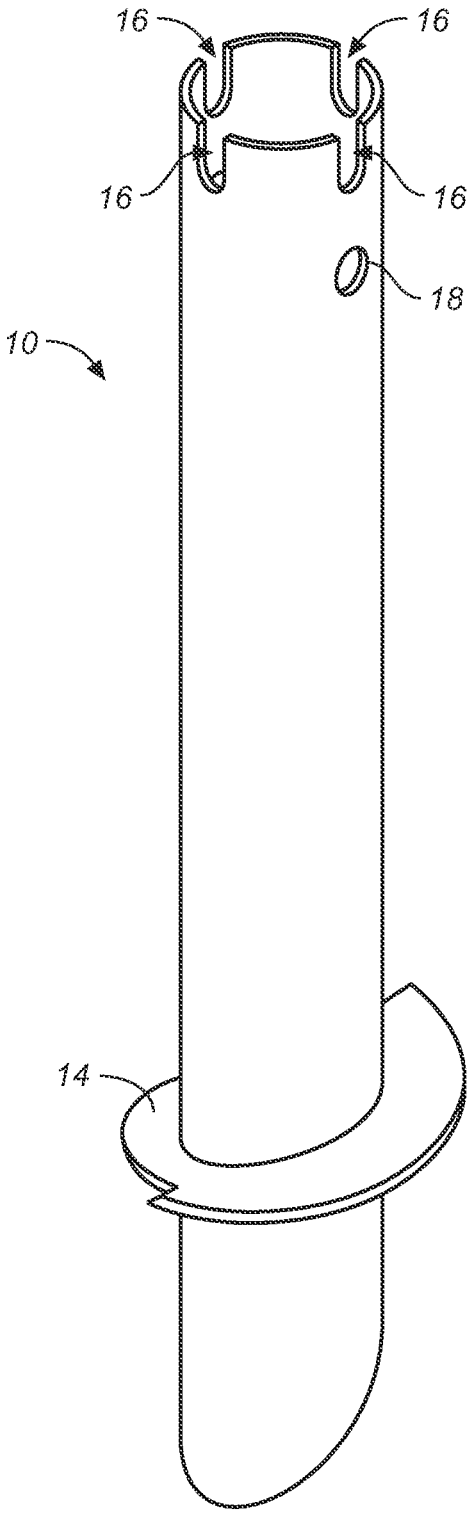
FIGS. 1A and 1B are upper right and upper left perspective views, respectively, of a foundation pile having two pairs of drive pin slots according to the invention.
Figure 1B:
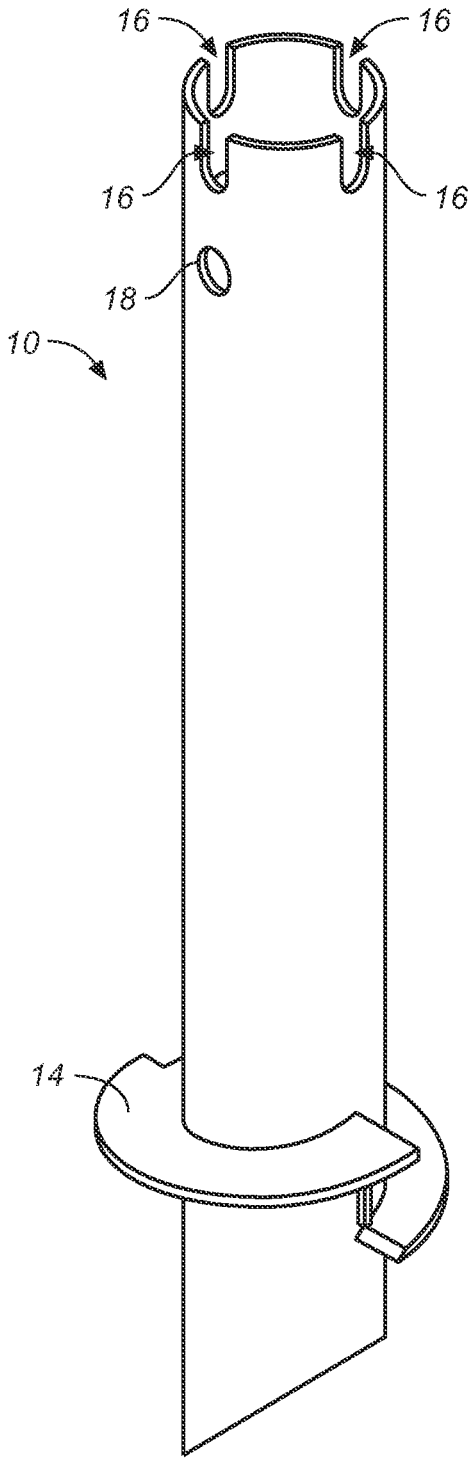
Figure 2A:
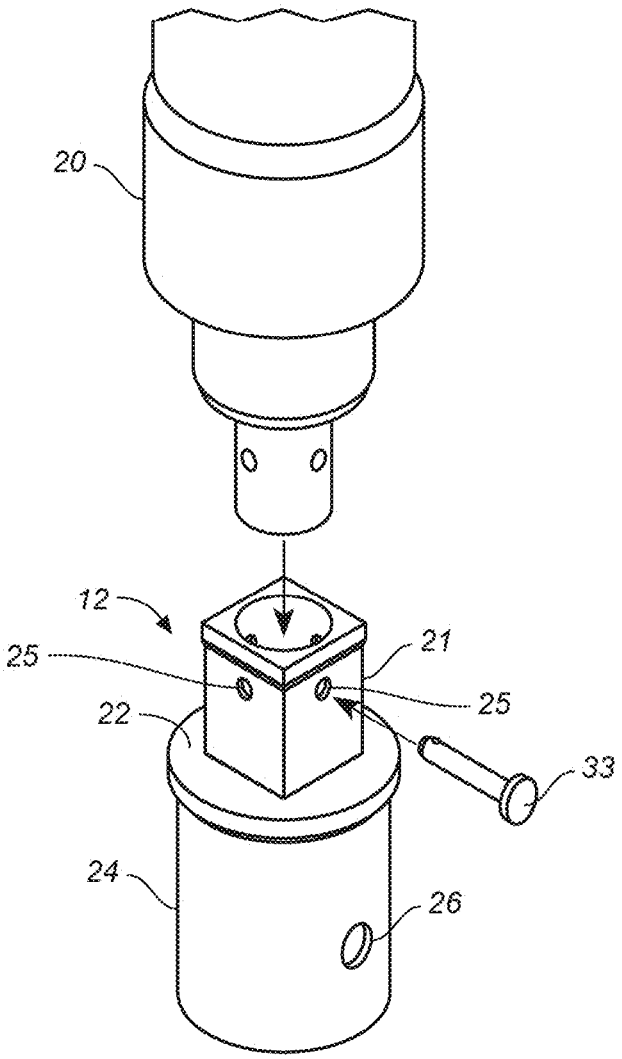
FIG. 2A is an exploded upper perspective view of a drive head and a pile installation tool according to the invention.
Figure 2B:
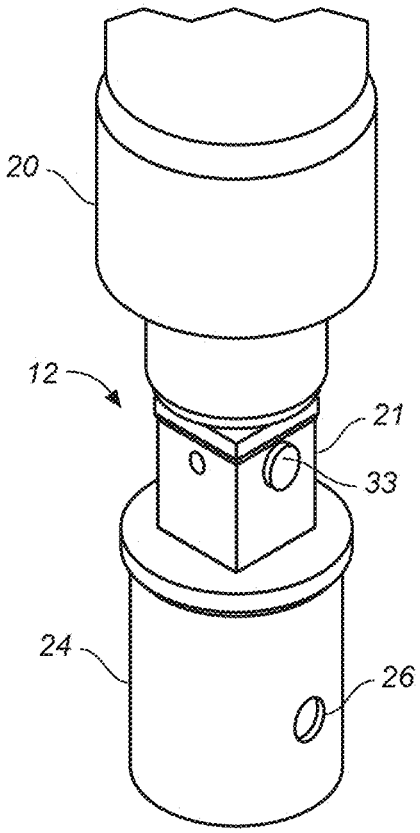
FIG. 2B is an upper perspective view of the drive head and pile installation tool shown in FIG. 2A in an assembled configuration.

A foundation pile installation system according to the invention comprises a pile 10, seen in FIGS. 1A and 1B, and a drive head 12 and a pile installation tool 20, seen in FIGS. 2A and 2B. The pile 10 is a hollow pile, generally having a helical flange 14, the pile being of the type that is installed in the ground using rotation and downward pressure (known in the field as "crowd"). Whereas a prior art pile has two pairs of pin receiving holes at the top end of the pile for receiving pins with which to attach a pile installation tool to the pile, a pile as seen in FIGS. 1A and 1B according to the invention, has two pairs of drive bar slots 16 on opposite sides of the pile and a single pair of pile attachment pin holes 18 as seen below the drive bar slots. In the illustrated embodiment, two pairs of drive bar slots 16 are disposed at 90° angles around the top of the pile. In another embodiment, only one pair or more than two drive bar slots are provided.

As seen in FIGS. 2A and 2B, the drive head 12 is configured for attachment to a pile installation tool 20 and includes a drive head cap 21, a lid 22 and a drive collar 24 descending from the lid. The drive head cap 21 includes drive cap attachment holes 25 for receiving a drive head attachment pin 33 and the drive collar 24 has drive collar attachment pin holes 26 for receiving a pile attachment pin 34 (discussed below).

Figure 3A:
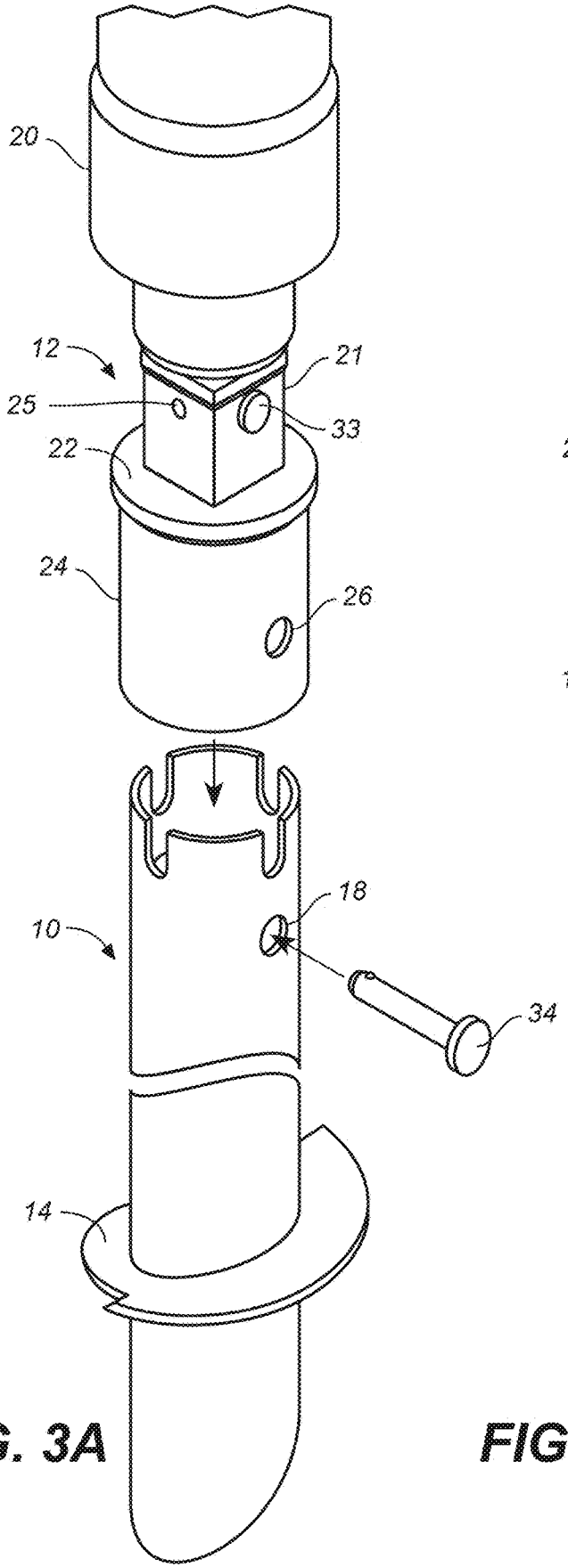
FIG. 3A is a exploded upper perspective view of a foundation pile and a drive head connected to a pile installation tool according to the invention.
Figure 3B:
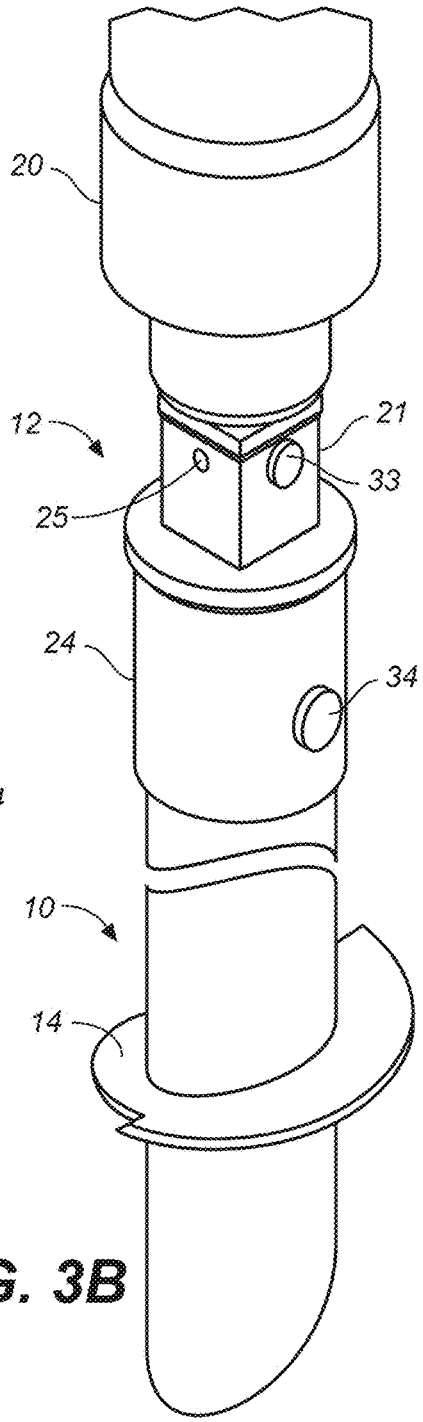
FIG. 3B is an upper perspective view of the foundation pile and a drive head connected to a pile installation tool shown in FIG. 3A in an assembled configuration.
Figure 4C:
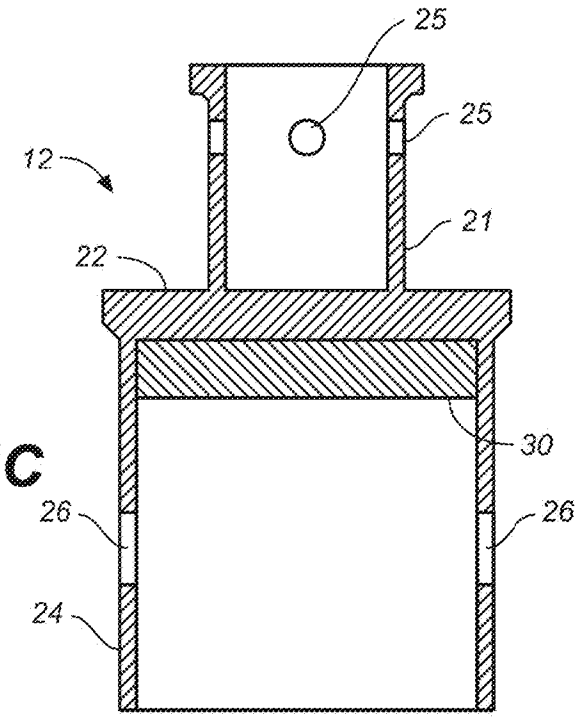
FIG. 4C is a sectional view of the drive head shown in FIG. 4A taken along lines 4C-4C.
Figure 5:
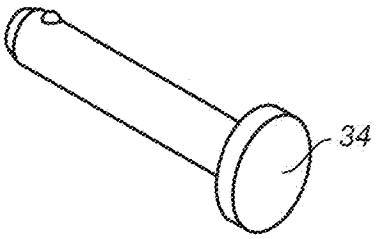
FIG. 5 is an upper perspective view of an attachment pin used to connect the drive head to the foundation pile.
Figure 4A:
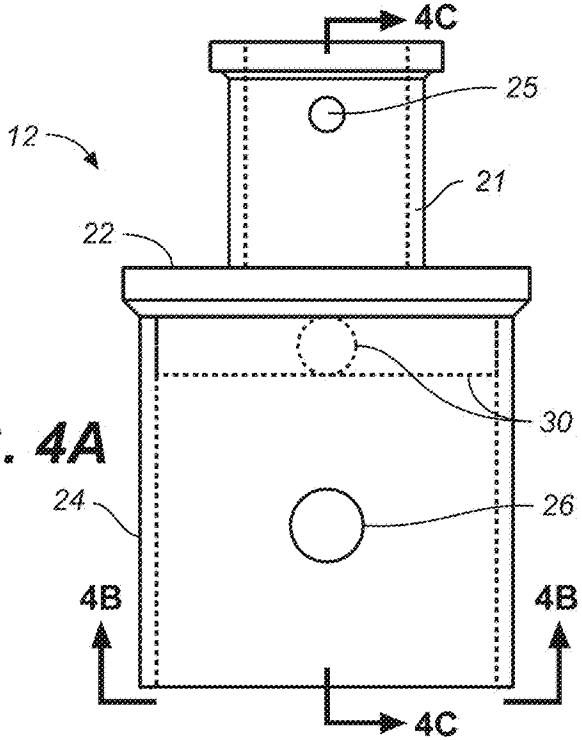
FIG. 4A is an elevational view of the drive head shown in FIGS. 2A-3B.
Figure 4B:
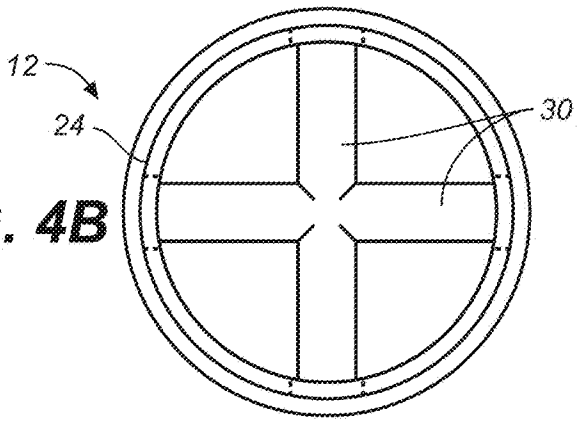
FIG. 4B is a bottom plan view of the drive head shown in FIG. 4A taken along lines 4B-4B.
Figure 6:
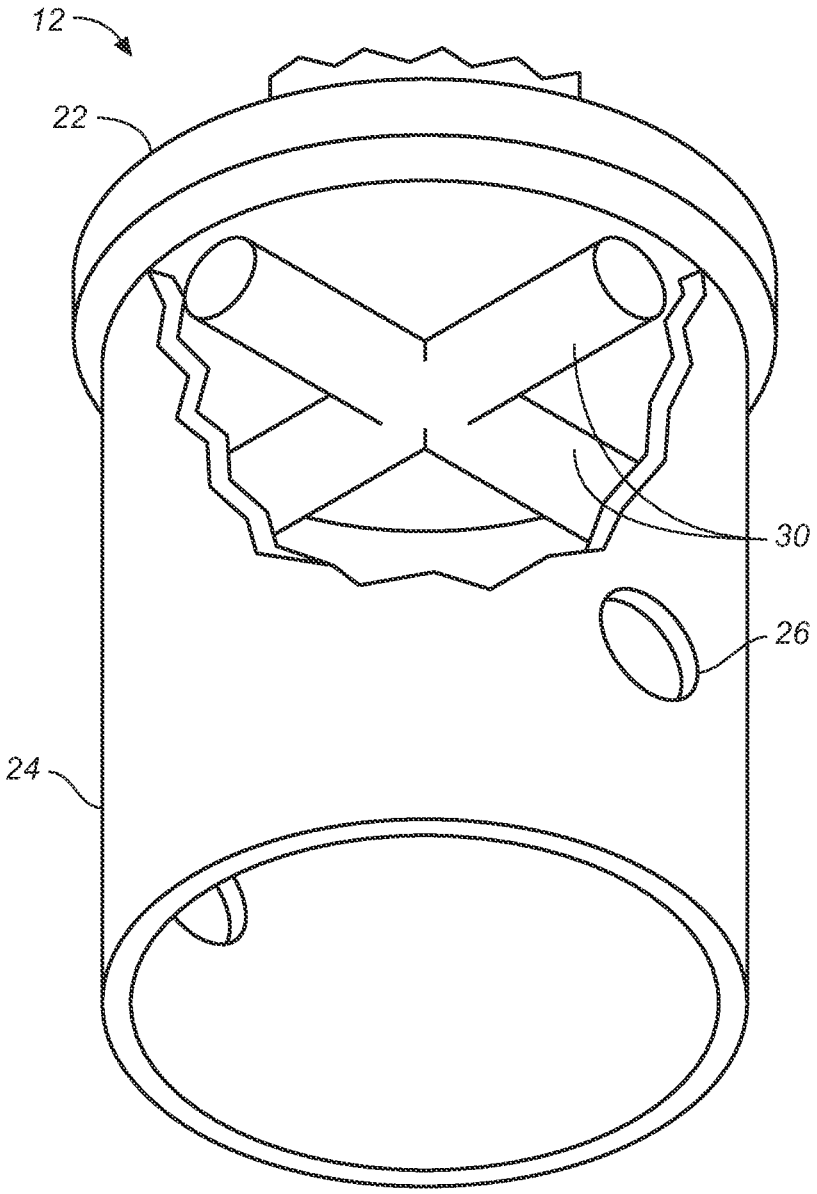
FIG. 6 is a lower perspective view of the drive head shown in FIGS. 4A and 4B with a cut away to show the interior of the drive head.

With reference now to FIGS. 3A-3B and 4A-4C, the hollow interior of the drive collar 24 is sized to receive a pile 10 and includes a pair of drive bars 30 arranged in a cross key configuration (see FIGS. 4B and 6). The drive bars 30 are directly secured to the underside of lid 22 and are sized to be closely received in drive bar slots 16 in the top of the pile 10. While the illustrated embodiment shows a pair of drive bars, in another embodiment one or more than two drive bars may be provided.

As seen in FIGS. 3A and 3B the drive head 12 is attached to the pile 10 by lowering the drive collar 24 over the top of the pile 10, twisting the pile until the drive bar slots 16 are radially aligned with the drive bars 30, then further lowering the drive collar 24 over the pile 10 until the drive bars 30 are receiving in the drive bar slots 16. It will generally be necessary to pick up the pile to move it to where it will be installed in the ground, so a pile attachment pin 34 can be installed in the pile attachment pin holes 18 in the pile 10 and in the cooperating drive collar attachment pin holes 26 in the drive collar 12 to secure the pile to the drive collar to allow the pile to be picked up by the pile installation tool 20 and moved to its installation location. Once the pile is established in the ground, the pile attachment pin 34 can be removed. Downward pressure by the pile installation tool and drive head on the pile will maintain the drive bars 30 in engagement with the drive bar slots 16 on the top of the pile. Once the pile has been driven to a desired depth, the drive collar 24 can be removed without the necessity of removing any attachment pins.

Figure 7A:
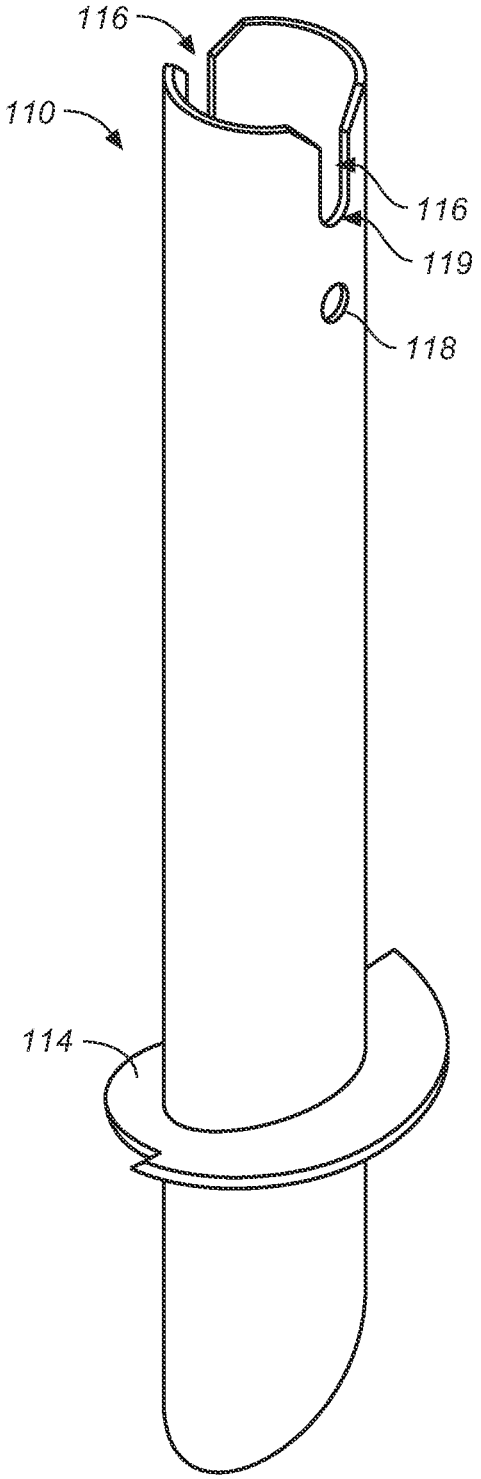
FIGS. 7A and 7B are right and left upper perspective view of a second embodiment of a pile according to the invention.
Figure 7B:
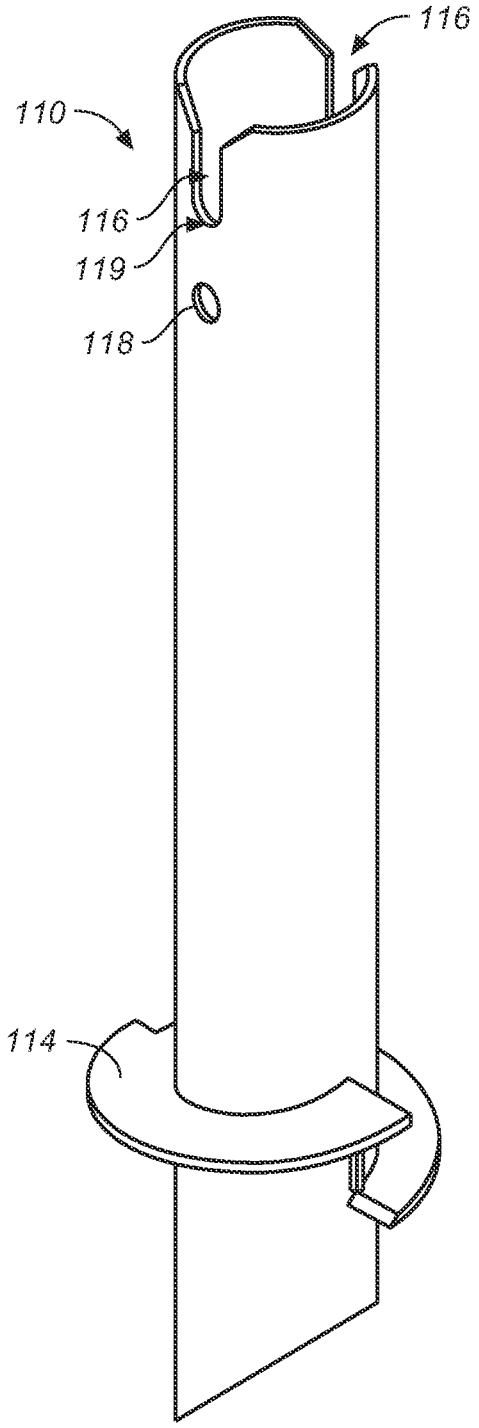

In another embodiment of the invention shown in FIGS. 7A-10C the pile 110 includes a pair of upwardly opening drive bar slots 116 disposed on opposite sides of the top end of the pile as best seen in FIGS. 7A-7B. The illustrated embodiment shows one pair of drive bar slots 116, but other embodiments may include two or more pairs of drive bar slots 116. Attachment pin holes 118 are axially spaced below the lower ends 119 of the drive pin slots 116 and radially aligned with the drive pin slots 116. A helical flight 114 is provided towards the lower end of the pile.

Figure 8A:
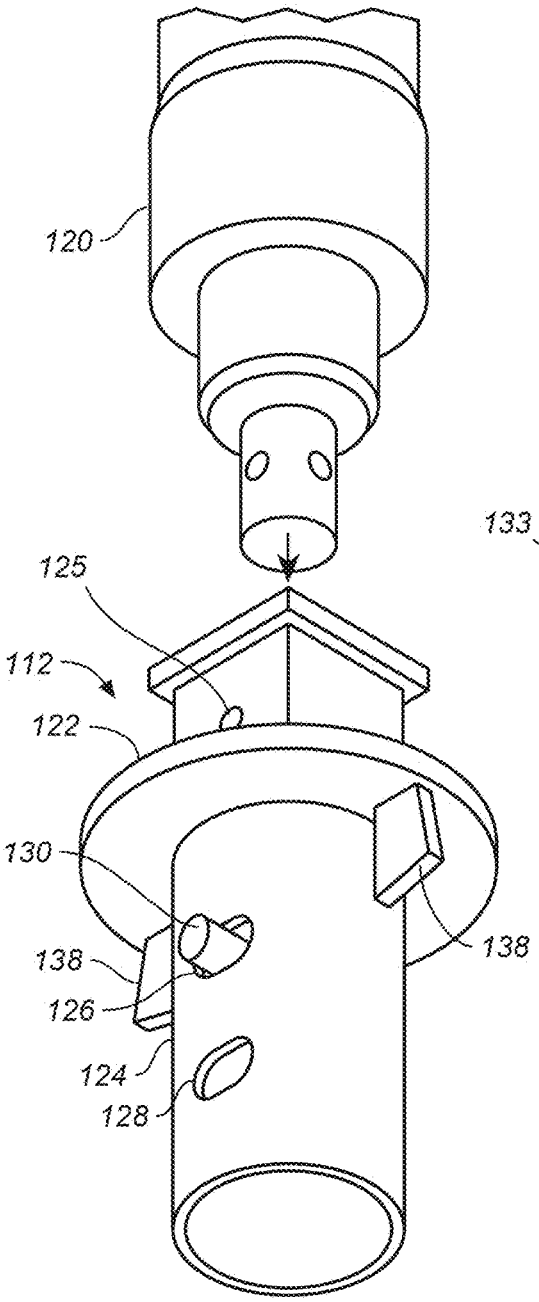
FIGS. 8A and 8B are exploded and assembled lower perspective views thereof.
Figure 8B:
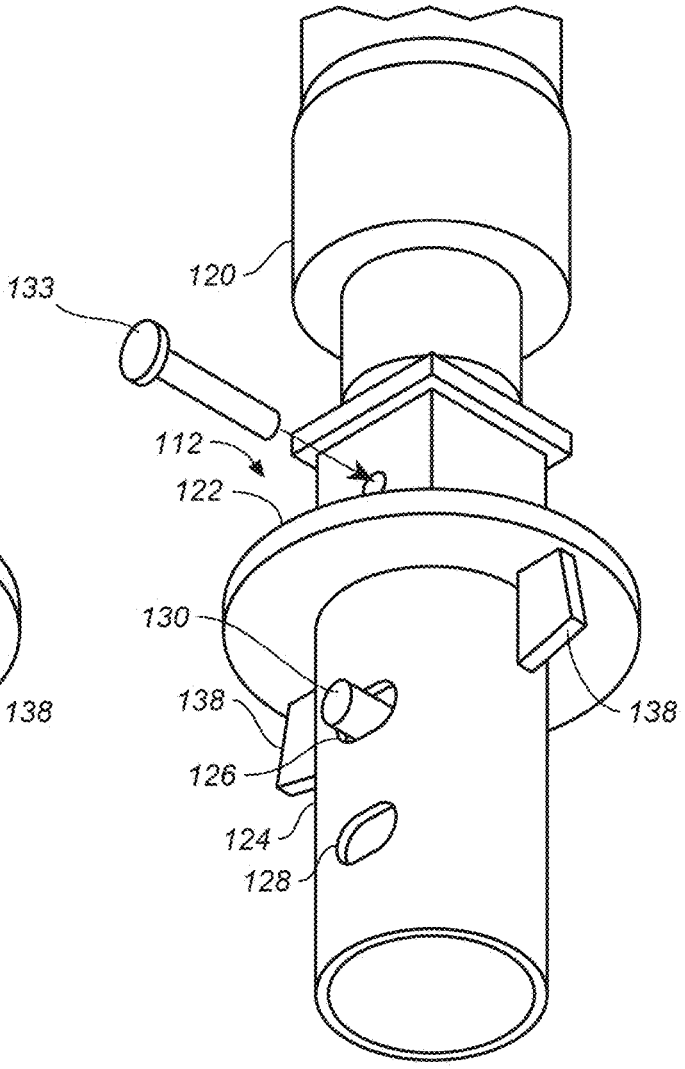
Figure 9:
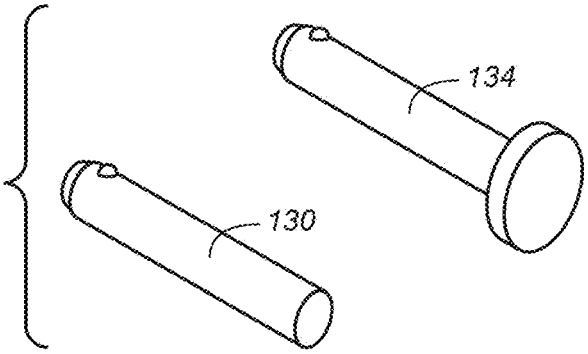
FIG. 9 are plans view of drive and attachment pins thereof.

In FIGS. 8A-8B it is seen that a drive head 112 is attached by inserting a drive head attachment pin 133 into drive cap attachment holes 125 provided in a drive head cap 121 into a driving rig 120. The drive head 112 includes a circular flange 122 that extends radially from the drive shaft 124. Drive bar holes 126 and attachment pin holes 128 are provided in the drive shaft 124 to receive drive bar 130 and attachment pin 134, respectively, shown in FIG. 9.

Figure 10A:
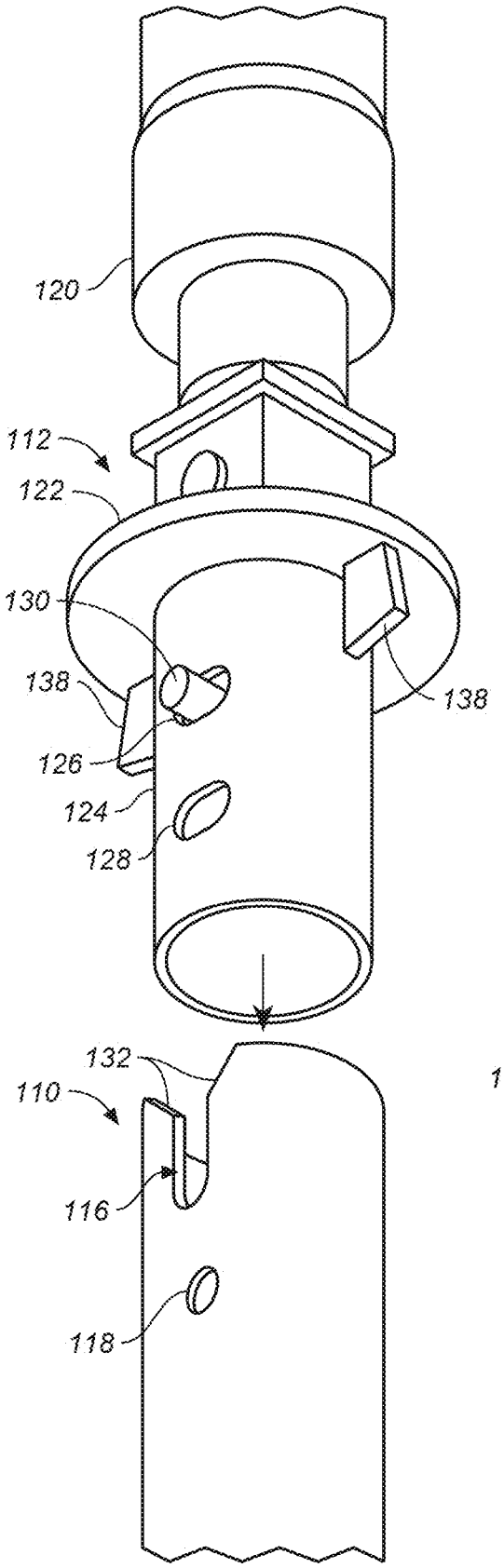
FIGS. 10A-10C are lower perspective views of a drive head being attached to a pile according to the second embodiment.
Figure 10B:
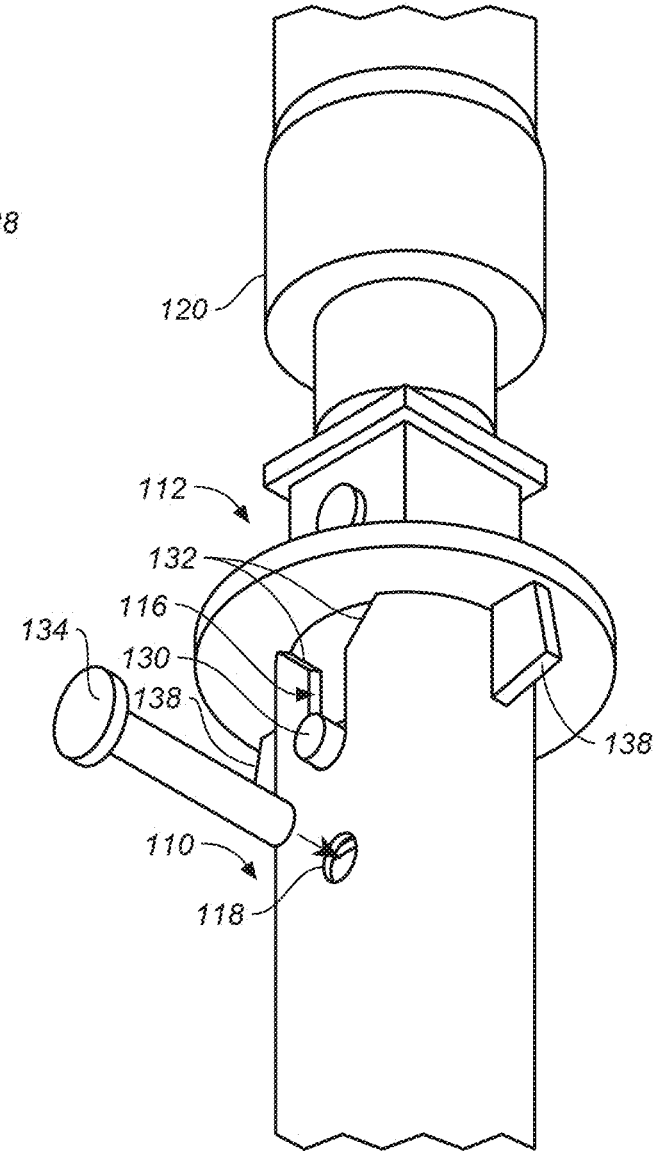
Figure 10C:
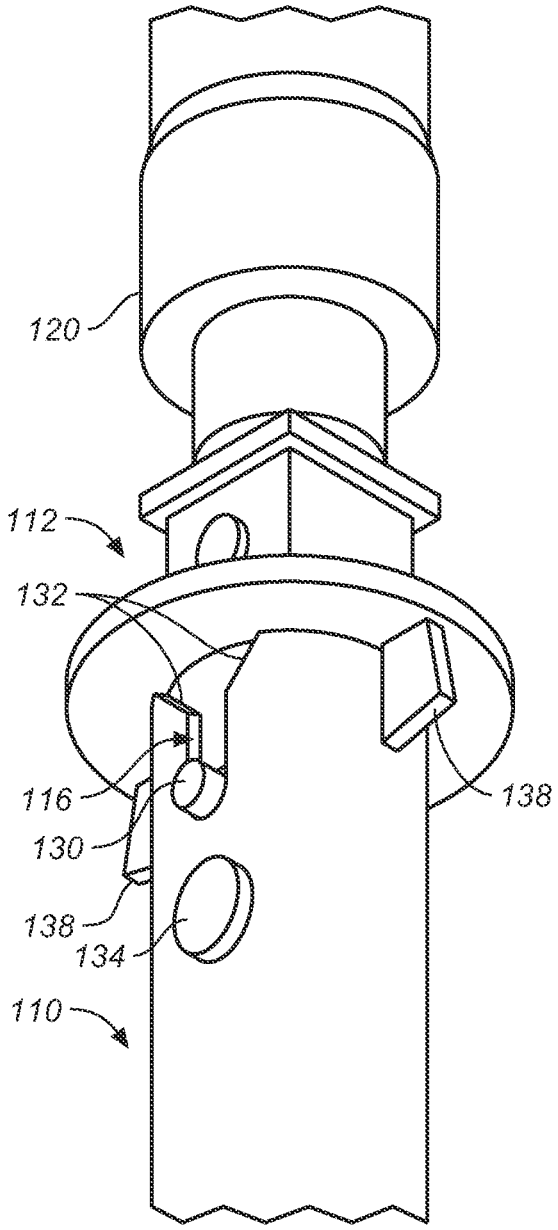

With reference now to FIGS. 10A and 10B, it is seen that the drive head 112 is attached to the pile 110 by preinstalling a drive bar 130 in the drive bar holes 126 in the drive shaft 124 and then inserting the drive shaft 124 into the hollow interior of the pile 110 as shown. In the illustrated embodiment, each drive bar slot 116 has tapered edges 132 to guide the drive bar 30 into the slot 16 as the drive head 12 is inserted into the pile. When the drive head 112 is fully inserted into the pile 110, the drive bar 130 orients the pile 110 so that the attachment pin holes 128 of the drive shaft 124 align with the attachment pin holes 118 of the pile 110, whereupon an attachment pin 134 can, if needed, be inserted mutually through the attachment pin holes 118 of the pile 110 and the attachment pin holes 128 of the drive shaft 124 to secure the drive shaft 124 to the pile 110. The pile can then be positioned where desired and driven into the soil. When the pile 110 has been driven down to a level where the attachment pin 134 is just above the ground, the attachment pin 134 can be removed and the pile 110 driven further into the ground, using only the drive bar 130, to a desired depth. Finally, when the pile has been driven to its specified depth, the drive shaft 124 can easily be separated from the pile by lifting it up. The drive slots 116 allow the pile to be driven to its specified depth even though the drive pin 130 may be below ground level.

As seen in FIGS. 8A-8B and 10A-10C, dual fins 138 descend from the lid 122 of the drive head 112 which excavates a trench in the ground around the top of the pile 110 as it nears depth. The trench allows use of the drive pin slot 116 as an inspection port, provides a reference point to install a concrete vibrator in the pile to ensure proper concrete consolidation, and allows air to escape while the concrete is being vibrated.

One advantage of the second embodiment of the invention is that the drive pin slots 116 in the pile 110 make securing the drive shaft 124 to and disengaging the drive shaft from the pile is facilitated by the ability to slide the drive pin 130, preinstalled in the drive shaft 124, in and out of the drive slots 116.

There have thus been described and illustrated certain embodiments of a foundation pile installation system according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A pile installation system, the system including a hollow foundation pile suitable for installation in the ground using rotary force and downward pressure, the system comprising:

the pile having a tubular body, a top end, one or more pairs of cooperating drive bar slots on opposite sides of the body, and one or more pairs of pile attachment pin holes, said drive bar slots each extending axially from and opening on said top end, a drive head having a drive collar and a lid, the drive collar having a hollow interior sized to receive the pile and one or more pairs of drive collar attachment pin holes, the lid having an underside, one or more drive bars affixed to the underside of the lid, an attachment pin, and an assembled configuration in which the top end of the pile is received in said drive collar and is abutting said lid, said drive bars are received in said drive bar slots for rotating the pile upon application of torque to the drive head, one of the pairs of said one or more pairs of drive collar attachment pin holes is aligned with one of the pairs of said one or more pairs of pile attachment pin holes, and the attachment pin is inserted in both said pair of drive collar attachment pin holes and said pair of pile attachment pin holes thereby securing the pile to the drive collar.

2. The pile installation system of claim 1 further comprising:

the top end of the pile having the one or more pairs of pile attachment pin holes spaced axially from the drive bar slots.

3. The pile installation system of claim 2 wherein the pile attachment pin holes are aligned radially with the drive bar slots.

4. The pile installation system of claim 2 further comprising:

the drive bar slots each having a lower end, and wherein the pile attachment pin holes of the pile are axially spaced from the lower ends of the drive bar slots.

5. The pile installation system of claim 1 wherein said one or more pairs of cooperating drive bar slots consists of one pair of cooperating drive bar slots.

6. The pile installation system of claim 5 wherein said one or more pairs of pile attachment pin holes consists of one pair of pile attachment pin holes axially spaced from and radially aligned with the drive bar slots.

7. A pile installation system, the system including a hollow foundation pile suitable for installation in the ground using rotary force and downward pressure, the system comprising:

the pile having a tubular body and a top end, one or more pairs of cooperating drive bar slots on opposite sides of the body, said drive bar slots each extending axially from and opening on the top end, a drive head having a drive collar and a lid, the drive collar having a hollow interior sized to receive the pile, the lid having an underside, one or more drive bars affixed directly to the underside of the lid, and an assembled configuration in which the top end of the pile is received in said drive collar and is abutting the lid and said one or more drive bars are received in said drive bar slots for rotating the pile upon application of torque to the drive head.

8. A method for installing a foundation pile in the ground, the method comprising:

inserting a top end of a pile into an interior of a drive collar, the drive collar having a lid covering said top end, radially aligning one or more pairs of drive bar slots of the pile with at least one of one or more drive bars of the drive collar, said drive bar slots extending axially from the top end of the pile, the drive bars affixed directly to an underside of the lid, and inserting at least one of the one or more drive bars in one of the one or more pairs of drive bar slots.

9. The method of claim 8 further comprising:

aligning one of one or more pairs of attachment pin holes in the pile with one of one or more pairs of attachment pin holes in the drive collar, and inserting an attachment pin in the aligned attachment pin holes of the pile and the drive collar to attach the pile to the drive collar.

10. The method of claim 9 further comprising:

applying downward pressure and torque to the drive head thence to the pile to drive the pile into the ground.

* * * * *